United States Patent [19]

Miyagi

[11] 4,436,073

[45] Mar. 13, 1984

[54] METHOD OF AND APPARATUS FOR CONTROLLING THE FUEL FEEDING RATE OF AN INTERNAL COMBUSTION ENGINE

[75] Inventor: Hideo Miyagi, Okazaki, Japan

[73] Assignee: Toyota Jidosha Kogyo Kabushiki Kaisha, Toyota, Japan

[21] Appl. No.: 296,242

[22] Filed: Aug. 24, 1981

[30] Foreign Application Priority Data

Sep. 1, 1980 [JP] Japan ..... 55-119832

[51] Int. Cl.[3] ..... F02B 3/02

[52] U.S. Cl. ..... 123/491; 123/480; 123/179 L; 123/438

[58] Field of Search ..... 123/480, 491, 179 L, 123/179 G, 438

[56] References Cited

U.S. PATENT DOCUMENTS

| | | | |
|---|---|---|---|
| 3,969,614 | 7/1976 | Moyer et al. | 123/480 |
| 3,971,354 | 7/1976 | Luchaco et al. | 123/491 |
| 4,171,692 | 10/1979 | Drews et al. | 123/491 |
| 4,193,380 | 3/1980 | Marchak et al. | 123/480 |
| 4,310,888 | 1/1982 | Furuhashi et al. | 123/491 |

*Primary Examiner*—Parshotam S. Lall

*Attorney, Agent, or Firm*—Cushman, Darby & Cushman

[57] ABSTRACT

Additional increment of the fuel feeding rate of an internal combustion engine during starting and for a period of time after starting is determined depending upon the warm-up condition of the engine and furthermore upon the rotational speed of the engine. The higher the rotational speed, the smaller the additional increment, and vice versa.

12 Claims, 8 Drawing Figures

| Fig. 2A |
| --- |
| Fig. 2B |

METHOD OF AND APPARATUS FOR CONTROLLING THE FUEL FEEDING RATE OF AN INTERNAL COMBUSTION ENGINE

BACKGROUND OF THE INVENTION

The present invention relates to a method of and apparatus for controlling the feeding rate of fuel fed into an internal combustion engine during starting and for a period of time after starting of the engine.

In an internal combustion engine of the electronic fuel injection control type using fuel injection valves, or of the electronic carburetor control type using an electrically controlled carburetor, an engine starting enrichment operation for additionally increasing the fuel feeding rate during cranking (starting) is executed. After starting, the above additional increment of the fuel feeding rate is decreased in accordance with the lapse of time. The above additional increment during starting is determined depending upon the warm-up condition of the engine.

According to the prior art, the above additional increment during starting and after starting is determined quite independently of the rotational speed of the engine. Therefore, if the rotational speed of the engine changes immediately after starting due to racing, good operation characteristics of the engine are not often obtained. In a case where the above-mentioned additional increment is selected to be an optimum value at a low rotational speed, the air-fuel mixture becomes too rich at high rotational speed. Accordingly, the rotational speed is not smoothly increased, causing the engine to respond sluggishly. Furthermore, the spark plug becomes clogged and fuel consumption is increased. Contrary to this, if the additional increment is selected to be an optimum value at a high rotational speed, the air-fuel mixture becomes too lean at a low rotational speed. Accordingly, the engine will backfire and respond sluggishly. Particularly, since the above-mentioned additional increment of the fuel feeding rate during starting and after starting is set to a considerably greater value than at other times, the operation characteristics are greatly influenced by this increment.

SUMMARY OF THE INVENTION

It is, therefore, an object of the present invention to provide a method of and apparatus for controlling the fuel feeding rate of an internal combustion engine, whereby the engine response is good during starting and for a period of time after starting.

Another object of the present invention is to provide a method of and apparatus for controlling the fuel feeding rate, whereby the spark plugs can be prevented from clogging and fuel consumption can be reduced.

According to the present invention, the load condition of the engine is detected to calculate the fuel feeding rate of the engine depending upon the detected load condition. Also the warm-up condition of the engine is detected to generate a first electrical signal which indicates the detected warm-up condition. It is also determined whether the engine is starting or not and a second electrical signal is generated which indicates the result. In response to the first and second electrical signals, an additional increment of the fuel feeding rate of the engine is calculated. The additional increment being determined in accordance with the detected warm-up condition during starting and, after starting, being decreased in accordance with the lapse of time. The rotational speed of the engine is further determined and a third electrical signal is generated which indicates the detected rotational speed. The calculated additional increment is corrected in response to the third electrical signal, and the fuel feeding rate is controlled in accordance with the caculated fuel feeding rate and the corrected increment.

The above and other related objects and features of the present invention will be apparent from the description of the present invention set forth below, with reference to the accompanying drawings, as well as from the appended claims.

DETAILED DESCRIPTION OF THE PREFERRED EMBODIMENT

Figure 1:
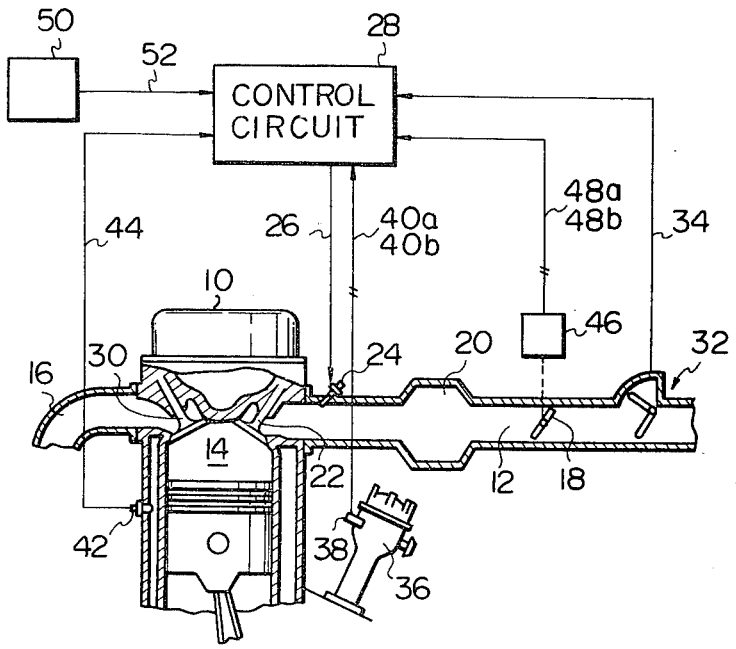
FIG. 1 is a schematical diagram of an electronic fuel injection control system of an internal combustion engine, on which a method of the present invention is used.

Referring to FIG. 1, reference numeral 10 denotes an engine body, 12 denotes an intake passage, 14 denotes a combustion chamber, and 16 denotes an exhaust passage. The flow rate of the air introduced through the air cleaner, which is not diagrammatized, is controlled by a throttle valve 18 that is interlocked to an accelerator pedal, which is not diagrammatized. The intake air is introduced into the combustion chamber 14 via a surge tank 20 and an intake valve 22. A fuel injection valve 24 is installed in the intake passage 12 in the vicinity of the intake valve 22, and is opened and closed responsive to electric drive pulses that are fed from a control circuit 28 via a line 26. The fuel injection valve 24 intermittently injects the compressed fuel that is supplied from a fuel supply system, which is not diagrammatized. The exhaust gas, which is produced by the combustion in the combustion chamber 14, is exhausted into the open air through an exhaust valve 30, an exhaust passage 16 and through a catalytic converter, which is not diagrammatized.

An air-flow sensor 32 is provided in the intake passage 12 in the upstream of the throttle valve 18, detects the flow rate of the air that is intaken, and sends an output signal to the control circuit 28 via a line 34.

A crank angle sensor 38 which is installed in a distributor 36 produces pulse signals at every crank angle of 30° and 360°. The pulse signals produced at every crank angle of 30° are fed to the control circuit 28 via a line 40*a*, and the pulse signals produced at every crank angle of 360° are fed to the control circuit 28 via a line 40*b*.

The output signal of a coolant temperature sensor 42 which detects the temperature of the coolant in the engine is fed to the control circuit 28 via a line 44.

A throttle sensor 46 interlocked to the throttle valve 18 produces pulse signals each time the throttle valve 18 is turned by a predetermined angle in the direction in which it opens, and the pulse signals are fed to the control circuit 28 via lines 48*a* and 48*b*.

From a starter motor 50 for cranking the engine, a signal which indicates the engine is starting is fed to the control circuit 28 via a line 52.

Figures 2, 2A:
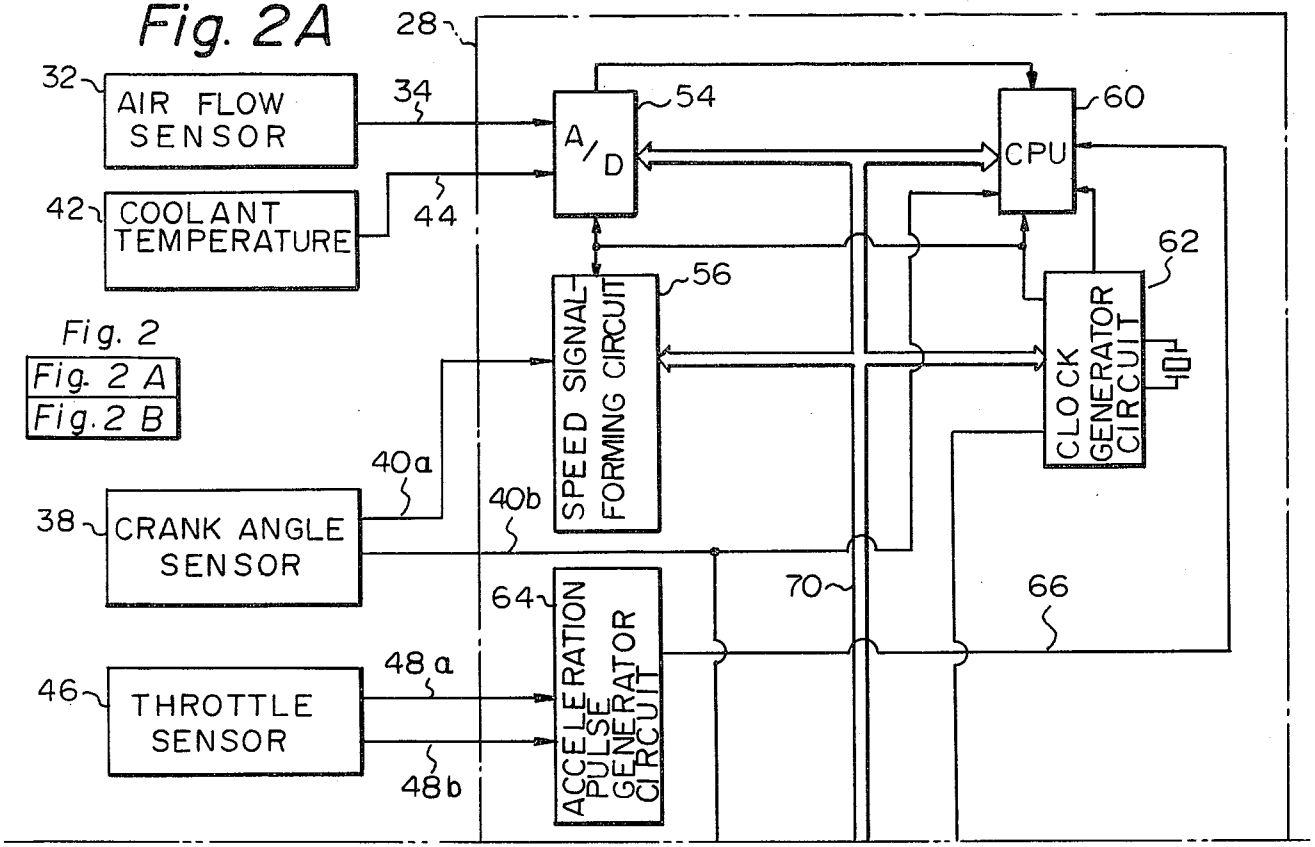
FIGS. 2A and 2B are a block diagram of a control circuit shown in FIG. 1.
Figure 2B:
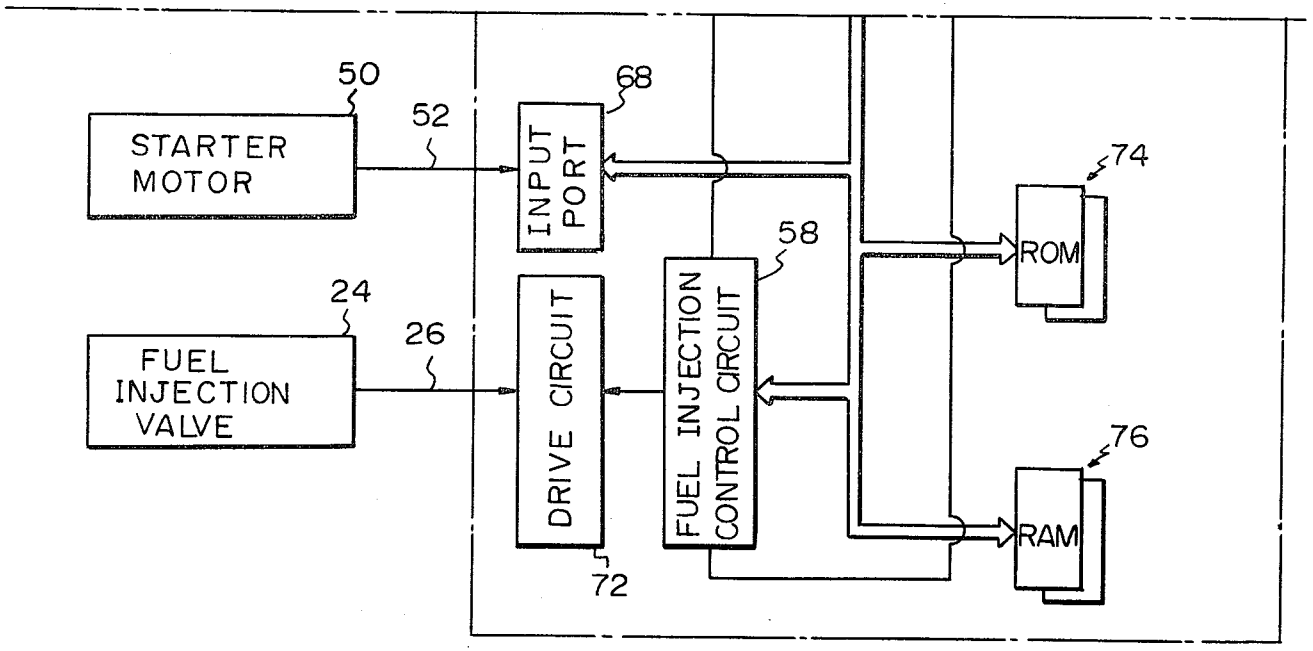

FIG. 2 is a block diagram illustrating the control circuit 28 of FIG. 1, in which the air-flow sensor 32, coolant temperature sensor 42, crank angle sensor 38, throttle sensor 46, starter motor 50 and fuel injection valve 24 that are illustrated in FIG. 1 are represented by blocks, respectively.

The output signals of the air-flow sensor 32 and the coolant temperature sensor 42 are fed to an analog-to-digital converter 54 which contains an analog multiplexer, and are converted into signals, in the form of binary numbers.

Pulses produced by the crank angle sensor 38 at every crank angle of 30° are fed to a speed signal-forming circuit 56 via the line 40*a*, and pulses produced at every crank angle of 360° are fed, as fuel injection initiation signals, to a fuel injection control circuit 58 via the line 40*b* and are further fed, as interrupt request signals for the fuel injection time arithmetic operation, to an interrupt input port of a central processing unit (CPU) 60 consisting of microprocessors. The speed signal-forming circuit 56 has a gate which is opened and closed by the pulses produced at every crank angle of 30° and a counter for counting the number of clock pulses which are fed from a clock generator circuit 62 via the gate, and produces a speed signal in the form of a binary number, which corresponds to the rotational speed of the engine.

The pulse signals produced by the throttle sensor 46 are applied to an acceleration pulse generator circuit 64 which produces acceleration pulses having a frequency which varies depending upon the accelerating degree. The acceleration pulses produced by the generator circuit 64 are fed, as interrupt request signals, to another interrupt input port of the CPU 60 via a line 66.

A start signal fed from the starter motor 50 via the line 52 is applied to an input port and is temporarily stored therein.

A fuel injection control circuit 58 has a presettable down counter and an output register. Output data which corresponds to the fuel-injection pulse-width $\tau$ is sent from the CPU 60 via a bus 70, and is set to the output register. As the pulses (fuel injection initiation signals) produced by the crank angle sensor 38 at every crank angle of 360° are applied, the thus set data is loaded on the down counter. At the same time, the output of the down counter is inverted to assume a high level, and then the loaded value is subtracted one by one for each application of the clock pulse from the clock generator circuit 62. When the loaded value becomes zero, the output of the down counter is inverted into a low level. Therefore, the output of the fuel injection control circuit 58 becomes an injection signal having a duration which is equal to the injection pulse-width $\tau$, and is fed to the fuel injection valve 24 via a drive circuit 72.

The A/D converter 54, the speed signal-forming circuit 56, the input port 68 and the fuel injection control circuit 58 are connected via a bus 70 to the CPU 60, read-only memory (ROM) 74, random access memory (RAM) 76, and clock generator circuit 62, which constitute the microcomputer. Via the bus 70, the input data and output data are transferred. Although not diagrammatized in FIG. 2, the microcomputer is provided with an output port, an input/output control circuit, a memory control circuit, and the like as is customary. In the ROM 74, there will have been stored beforehand a routine program for main processing that will be mentioned later, an interrupt processing program for the arithmetic calculation of the fuel injection time, an interrupt processing program for the arithmetic calculation of the fuel increment, and various data that are necessary for carrying out the arithmetic calculation.

Next, the operation of the microcomputer in the control circuit 28 will be illustrated with reference to the flow diagrams of FIGS. 3 and 4.

In the main processing routine, the CPU 60 introduces new data which indicates the rotational speed N of the engine from the speed signal-forming circuit 56, and stores it in a predetermined region in the RAM 76. The CPU 60 further introduces new data which indicates the flow rate Q of the air intaken by the engine and new data which indicates the coolant temperature W relying upon the routine for interrupting and processing the analog-to-digital conversion executed at every predetermined period of time, and stores them in predetermined regions in the RAM 76.

Figure 3:
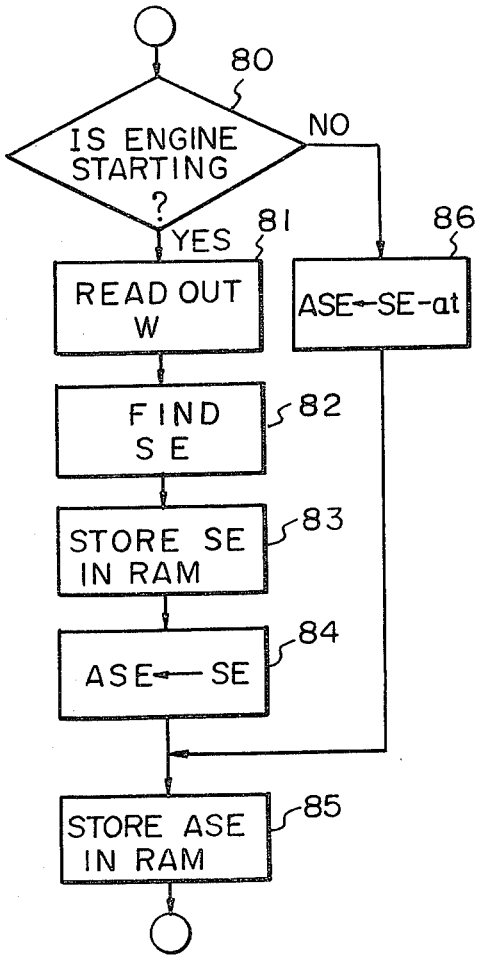
FIGS. 3 and 4 are flow diagrams of control programs according to an embodiment of the present invention.
Figure 5:
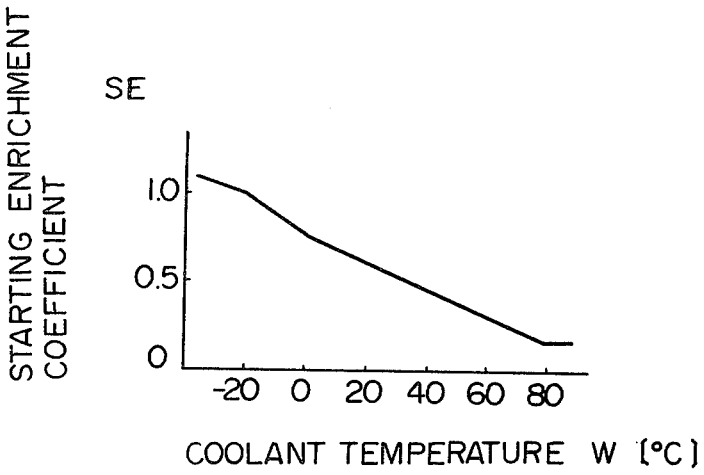
FIG. 5 is a graph of the starting enrichment coefficient SE versus the coolant temperature.

Moreover, the CPU 60 executes the processing shown in FIG. 3 during the main processing routine. First, at a point 80, the CPU 60 discriminates whether the starter motor 50 is being energized or not, i.e., whether the engine is cranking or not, based upon a signal which is applied from the starter motor 50 to the input port 68. When it is discriminated that the engine is cranking at a point 81, the CPU 60 reads out the data related to the coolant temperature W from the RAM 76, and at a point 82 finds a starting enrichment coefficient SE depending upon the coolant temperature W. In the ROM 74 has been stored beforehand a relation of the starting enrichment coefficients SE relative to the coolant temperature W as shown in FIG. 5 in the form of a W-SE table. At the point 82, the CPU reads out the SE value from the above table. At a point 83, the SE value is stored in a predetermined region in the RAM 76, and at a point 84, the value SE is given as an initial value of an after starting enrichment coefficient ASE. Then, at a point 85, the CPU 60 stores the coefficient ASE in a predetermined region in the RAM 76.

When the engine is starting, the above processing routine is repeated, and the SE value is renewed each time. After starting of the engine, the program proceeds from the point 80 to a point 86 where the coefficient ASE is calculated from an equation of $ASE=SE-at$, where a denotes a constant, and t denotes an output of the timer which commences the measurement from a moment at which the starting operation is finished. Namely, t represents the lapse of time from the moment at which the starting operation is finished, and the coefficient ASE decreases with the lapse of time t. The above-mentioned timer may be a software timer, which performs the counting on a predetermined time interrupt processing routine, or a hardware timer, which is actuated by the software technique. The program then proceeds to the point 85. The processing routines of these steps 80, 86 and 85 are then repetitively executed.

Figure 4:
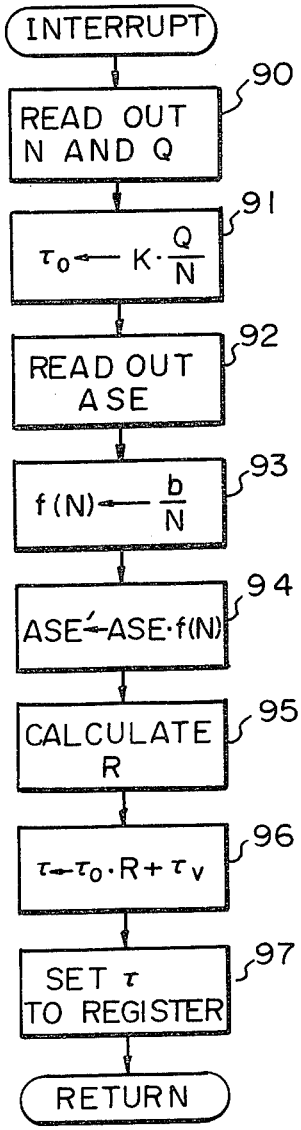

As the interrupt request signals produced at every crank angle of 360° are applied via the line 40*b*, on the other hand, the CPU 60 executes an interrupt processing routine for calculating the fuel injection time as shown in FIG. 4. First, at a point 90, the CPU 60 reads out the data related to the flow rate Q of the intake air and the rotational speed N from the RAM 76, and, at a point 91, calculates a basic fuel-injection pulse-width $\tau_o$ of the injection signal fed to the fuel injection valve 24, according to the following equation, $$\tau_o = K \cdot (Q/N)$$

where K is a constant. At a point 92, the CPU 60 reads out from the RAM 76 the coefficient ASE that was memorized in the main routine. At the next point 93, the CPU 60 calculates a function f(N) which decreases with the increase in the rotational speed N and which increases with the decrease in the rotational speed N. The function can be given, for example, by $f(N)=b/N$, where b is a constant. The function, however, can be expressed in a variety of other forms. Here, the variable range of the function f(N) should desirably be restricted, as given by $c \leqq f(N) \leqq d$ (where c and d are predetermined constants).

At the point 94, the CPU 60 performs the calculation of $ASE' = ASE \cdot f(N)$ to correct the after starting enrichment coefficient ASE depending upon the rotational speed N of the engine, and then total enrichment coefficient R corresponding to a total additional increment of the fuel feeding rate by using the thus corrected coefficient ASE' at a point 95. If a normal warm-up enrichment coefficient is denoted by WL, an acceleration enrichment coefficient by ACE, and if a heavy-load enrichment coefficient is denoted by HLE, the total enrichment coefficient R is calculated from an equation of $$R = WL \cdot (ASE' + ACE + HLE + 1.0)$$

Figure 6:
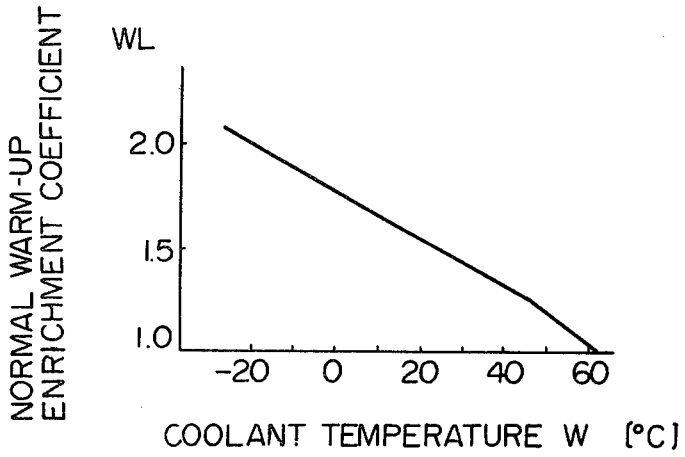
FIG. 6 is a graph of the normal warm-up enrichment coefficient WL versus the coolant temperature.

The normal warm-up enrichment coefficient WL is to increase the fuel feeding rate depending upon the warm-up condition when the engine is in warming-up operation, and is determined depending upon the coolant temperature W as shown in FIG. 6. As will be obvious from FIG. 6, the coefficient WL is set to 1.0 when the engine is fully warmed-up. The acceleration enrichment coefficient ACE is to increase the fuel-feeding rate when the engine is under the acceleration condition. The coefficient ACE is increased only by a predetermined amount according to a predetermined interrupt processing routine after each production of an acceleration pulse from the acceleration pulse generator circuit 64, and is gradually decreased after the completion of the acceleration operation. The heavy-load enrichment coefficient HLE is to increase the rate of feeding the fuel when the engine is subjected to heavy-load operation conditions. The above-mentioned coefficients ASE', ACE and HLE remain zero when the respective enrichment is not required.

At the point 96, then, the CPU 60 calculates the pulse-width $\tau$ from the following equation, $$\tau = \tau_o \cdot R + \tau_v$$

where $\tau_v$ is a value that corresponds to an ineffective injection pulse-width of the fuel injection valve 24. The data which corresponds to the thus calculated pulse-width $\tau$ is set at a point 97 to the output register of the fuel injection control circuit 58, whereby the interrupt processing routine is finished and the program returns to the main routine.

Figure 7:
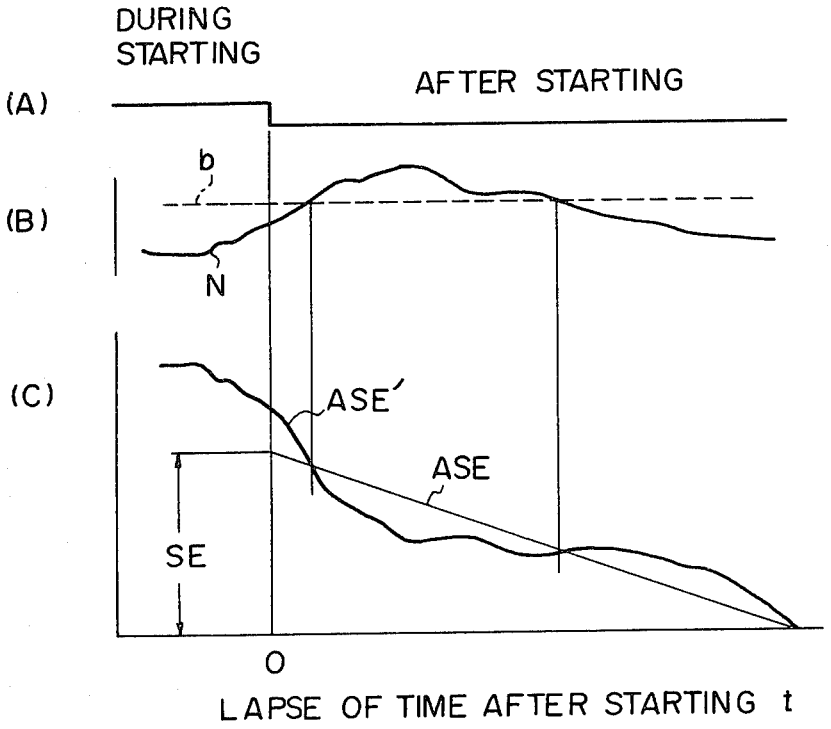
FIG. 7 is a graph for illustrating the mode of operation of the embodiment.

Functions of the above-mentioned embodiments will be illustrated below with reference to FIG. 7, in which (A) shows a signal that represents whether the engine is starting or not, (B) shows the rotational speed N of the engine, and (C) shows starting enrichment coefficient SE after the starting enrichment coefficient ASE and the corrected coefficient ASE'. The abscissa in FIG. 7 represents the lapse of time t from the moment at which the starting operation of the engine is finished.

According to the conventional art, the starting enrichment coefficient SE was controlled, during starting, to remain constant (when the coolant temperature W was constant) as shown in the diagram (C). According to the embodiment of the present invention, however, the starting enrichment coefficient SE is controlled responsive to the rotational speed N, i.e., the coefficient SE is increased as illustrated by ASE' when the rotational speed N is smaller than the constant b. According to the conventional art, furthermore, the after starting enrichment coefficient ASE was linearly decreased after the starting operation has been finished. With the embodiment of the present invention, however, the corrected coefficient ASE' is controlled so as to become greater than the coefficient ASE when the rotational speed N is smaller than the constant b and becomes smaller than the coefficient ASE when the rotational speed N is greater than the constant b. According to the present invention as mentioned above, the additional increment of the fuel-feeding rate is controlled depending upon the rotational speed of the engine during starting and for a period of time after starting of the engine, causing the air-fuel ratio to be controlled at an optimum value. Consequently, the rotational speed of the engine rises smoothly, afterburning is eliminated, the engine is not sluggish, spark plugs are prevented from becoming clogged, and consumption of the fuel is decreased.

In the above-mentioned embodiment, the interrupt processing routine for calculating the fuel injection time is executed at every crank angle of 360°, however, this interrupt processing routine may be executed at any predetermined interval of time.

According to the present invention as illustrated in detail in the foregoing, it is possible to suitably control the rate of feeding the fuel during starting and for a period of time after starting of the engine, offering good engine response, improved fuel consumption, and preventing the spark plugs from being clogged. Here, the starting enrichment SE when the engine is starting need not necessarily be equal to the initial value of the after starting enrichment ASE. Furthermore, after starting, the enrichment ASE may be decreased by a predetermined rate in synchronism with the rotation of the engine, instead of being decreased with the lapse of time.

As many widely different embodiments of the present invention may be constructed without departing from the spirit and scope of the present invention, it should be understood that the present invention is not limited to the specific embodiments described in this specification, except as defined in the appended claims.

I claim:

1. A method of controlling the fuel feeding rate of an internal combustion engine, comprising the steps of:

detecting the load condition of said engine;

generating a first electrical signal related to the warm-up condition of said engine;

generating a second electrical signal related to whether said engine is starting or not;

generating a third electrical signal related to the rotational speed of said engine;

determining a fuel feeding amount for every engine revolution in accordance with said detected load condition;

calculating, in response to said first and second electrical signals, an additional increment of the fuel feeding amount for every engine revolution, said additional increment being determined in accordance with said detected warm-up condition during starting and, after starting, being decreased in accordance with the lapse of time;

correcting said calculated additional increment in response to said third electrical signal, said calculated additional increment being corrected to increase when the detected rotational speed decreases and to decrease when the detected rotational speed increases; and controlling the fuel feeding amount for every engine revolution in accordance with said determined fuel feeding amount and said corrected increment.

2. A method as claimed in claim 1, wherein said correcting step includes the step of correcting the calculated additional increment to a value which is inversely proportional to the detected rotational speed.

3. A method as claimed in claim 1, wherein said first signal generating step includes a step of detecting the temperature of the coolant of the engine, said first electrical signal indicating the detected coolant temperature.

4. A method as claimed in claim 1, wherein said engine has a starter motor and said second signal generating step includes a step of discriminating whether the starter motor is energized or not to generate a second electrical signal which indicates the discriminated result.

5. A method as claimed in claim 1, wherein said load condition detecting step includes a step of detecting the rotational speed of the engine and the flow rate of air sucked into the engine, the fuel feeding amount for every engine revolution being determined in accordance with the detected rotational speed and flow rate of air.

6. A method as claimed in claim 1, wherein said method further comprises the steps of:

calculating a second additional increment of the fuel feeding amount for every engine revolution in response to said first electrical signal irrespective of said second electrical signal; and correcting said corrected increment in accordance with said second additional increment, said twice corrected increment being used for controlling the fuel feeding amount instead of said corrected increment.

7. An apparatus for controlling the rate of fuel supplied to an internal combustion engine comprising:

means for detecting the load condition of said engine;

means for generating a first electrical signal related to the warm-up condition of said engine;

means for generating a second electrical signal related to whether said engine is starting or not;

means for generating a third electrical signal related to the rotational speed of said engine;

processing means for (1) determining a fuel feeding amount for every engine revolution in accordance with said detected load condition, (2) calculating, in response to said first and second electrical signals, an additional increment of the fuel feeding amount for every engine revolution, said additional increment being determined in accordance with said detected warm-up condition during starting and, after starting, being decreased in accordance with the lapse of time, and (3) correcting said calculated additional increment in response to said third electrical signal, said correcting function correcting the calculated additional increment to increase the increment when the detected rotational speed decreases and to decrease the increment when the detected rotational speed increases; and means for controlling the fuel feeding amount for every engine revolution in accordance with said calculated fuel feeding rate and said corrected increment.

8. An apparatus as in claim 7, wherein said processing means correcting function corrects the calculated additional increment to a value which is inversely proportional to the detected rotational speed.

9. An apparatus as in claim 7, wherein said first signal generating means includes means for detecting the temperature of the coolant of the engine, said first electrical signal indicating the detected coolant temperature.

10. An apparatus as in claim 7, wherein said engine includes a starter motor and said second signal generating means includes means for discriminating whether said starter motor is energized or not to generate said second electrical signal which indicates the discriminated result.

11. An apparatus as in claim 7, wherein said load condition detecting means includes means for detecting the rotational speed of the engine and the flow rate of air sucked into the engine, said processing means determining said fuel feeding amount for every engine revolution in accordance with the detected rotational speed and flow rate of air.

12. An apparatus as in claim 7, wherein said processing means also functions to calculate a second additional increment of the fuel feeding amount for every engine revolution in response to said first electrical signal irrespective of said second electrical signal, and correct said corrected increment in accordance with said second additional increment, said twice corrected increment being used for controlling the fuel feeding rate instead of said corrected increment.

* * * * *